United States Patent [19]

Iwata

[11] Patent Number: 4,565,180

[45] Date of Patent: Jan. 21, 1986

[54] CONTACTLESS IGNITION DEVICE FOR INTERNAL COMBUSTION ENGINES

[75] Inventor: Masao Iwata, Yokosuka, Japan

[73] Assignee: Oppama Kogyo Kabushiki Kaisha, Yokosuka, Japan

[21] Appl. No.: 597,173

[22] Filed: Apr. 5, 1984

[30] Foreign Application Priority Data

May 17, 1983 [JP] Japan ..... 58-73333[U]

[51] Int. Cl.[4] ..... F02P 5/08

[52] U.S. Cl. ..... 123/602; 123/603

[58] Field of Search ..... 123/602, 601, 599, 418, 123/603, 618

[56] References Cited

U.S. PATENT DOCUMENTS

| | | | |
|---|---|---|---|
| 3,750,637 | 8/1973 | Minks | 123/599 |
| 3,861,372 | 1/1975 | Shibukawa et al. | 123/602 |
| 3,866,589 | 2/1975 | Haubner et al. | 123/418 |
| 4,181,114 | 1/1980 | Carlsson et al. | 123/601 |
| 4,244,337 | 1/1981 | Asai | 123/603 |
| 4,297,977 | 11/1981 | Boyama | 123/599 |
| 4,473,050 | 9/1984 | Kondo et al. | 123/602 |

FOREIGN PATENT DOCUMENTS

| | | | |
|---|---|---|---|
| 57-20559 | 2/1982 | Japan | 123/599 |

*Primary Examiner*—Andrew M. Dolinar

*Attorney, Agent, or Firm*—Murray Schaffer

[57] ABSTRACT

An exciter coil and pulser coil induce voltages in phase reversal to each other by the rotation of an internal combustion engine are provided. A first condenser and second condenser are charged with the negative and positive induced voltage of the exciter coil respectively. A second switching element conductive by the discharged voltage of the second condenser discharged through a first switching element conductive when the induced voltage of the pulser coil reaches a set level is connected in series with a circuit connecting the ignition coil and first condenser. A circuit controlling the switching time of the first switching element is operated so as to retard the operation of the second switching element in the low speed operation range of the engine and to advance the same in the high speed operation range. This circuit includes a further switching element operating in response to the voltage inducing state of the pulser coil.

3 Claims, 4 Drawing Figures

CONTACTLESS IGNITION DEVICE FOR INTERNAL COMBUSTION ENGINES

FIELD OF THE INVENTION

The present invention relates to a contactless ignition device for an internal combustion engine and more particularly to a contactless ignition device for internal combustion engines wherein the ignition timing is controlled by a pulser coil provided on the same iron core as that of an exciter coil and a controlling circuit connected to this pulser coil.

BACKGROUND OF THE INVENTION

A magnet generator type ignition device has been extensively adopted for such internal combustion engines as, for example, chain saws and special vehicles. Such devices provide an electric source of high voltage current not from a battery but from a magnet generator wherein the low voltage current generated by the magnet generator is made high in voltage by an ignition coil and fed to the spark plugs.

For constant high speed operation of such engines the ignition time in the engine is advantageously set near 30 degrees before the top dead center so that the combustion efficiency of the gaseous mixture may be maximized. However, when the speed rotation of the internal combustion engine is low as at the time of starting the engine, the same timing as mentioned above is disadvantageous since the engine will tend to reversely rotate making the starting difficult. That is to say, problems have arisen when the rotation speed of the internal combustion engine is low, if the ignition occurs within 30 degrees before the top dead center, because the piston will lower before it reaches the top dead center causing a push-back force reversely rotating the internal combustion engine.

BRIEF SUMMARY OF THE INVENTION

The present invention provides a contactless ignition device for internal combustion engines whereby, when in a low speed rotation range as at the time of starting the engine, the ignition time will be temporarily retarded, for example, to be near 10 degrees before the top dead center so as to improve startability, but thereafter, when the engine is in a set rotation range after starting, the ignition time will be advanced to provide the desired combustion efficiency.

The ojects of the present invention are obtained by providing an exciter coil and pulser coil inducing voltage by the rotation of an internal combustion engine which are in reverse phase to each other. A first condenser and second condenser are charged with the induced voltage of the exciter, and the discharge of the first condenser causes an ignition coil receiving the discharged voltage to feed a high voltage to a spark plug. A first switching element which is conductive at the induced voltage of the pulser coil enables the discharge of the second condenser, while a second switching element enables the discharge of the first condenser upon the conduction of the first switching element and a third switching element conducting in the set rotation range of the engine driving the above mentioned second switching element.

Therefore, in response to the state of the induced voltage of the pulser coil, the third switching element is made to conduct or non-conduct so that the conduction of the first switching element and the timing of the conduction will be controlled, and, by the conduction of this first switching element, the second switching element is made to conduct so that the discharged current will be made to flow to the ignition coil by the first condenser.

DETAILED DESCRIPTION OF THE INVENTION

Figure 1:
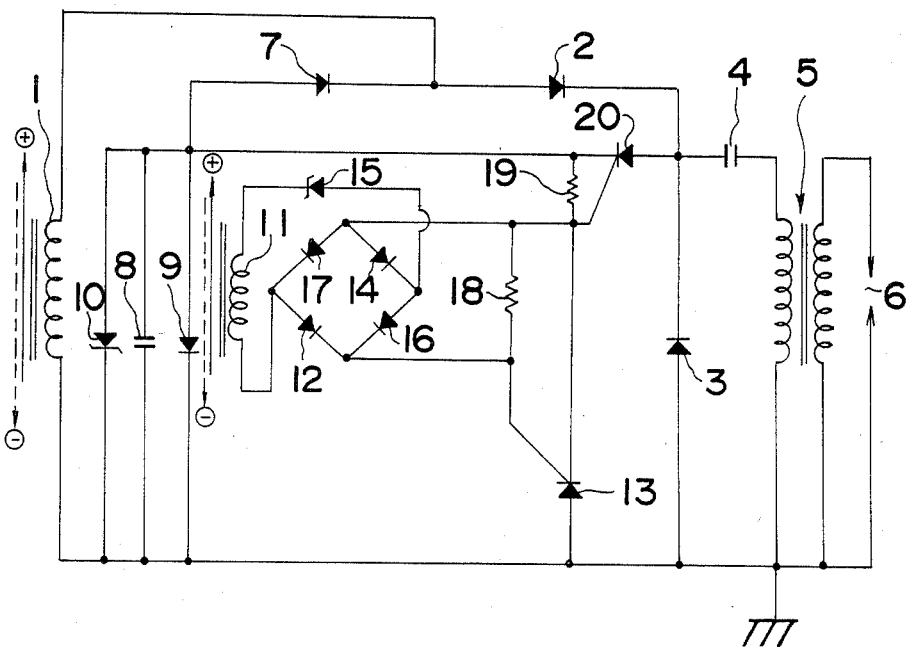
FIG. 1 is a circuit diagram of an ignition device for internal combustion engines according to the present invention.

In FIG. 1, which is the electric circuit diagram concretely showing a contactless ignition device, an exciter coil 1 is connected to the primary side of an ignition coil 5 through a diode 2 and a first condenser 4. A diode 3 is connected as illustrated to a spark discharge circuit formed of an L-C circuit of a first condenser 4 and the primary side coil of the ignition coil 5. A spark plug 6 is connected to the secondary side of the ignition coil 5. Further, the cathode of a diode 7 is connected to the intermediate connecting point of the exciter coil 1 and diode 2. The anode side of this diode 7 is connected to the gate through the cathode of a thyristor 20 which is a second switching element and a resistance 19. The anode of this thyristor 20 is connected to the condenser 4.

The anode of the diode 7 is connected to the anode of the second diode 3 through a second condenser 8, diode 9 and Zener diode 10.

A pulser coil 11 is connected to a thyristor 13 which is a first switching element through a Zener diode 15 which is a third switching element and to a full wave rectifier comprising the bridge connected diodes 12, 14, 16 and 17. A resistor 18 is connected between the gate and cathode of the thyristor 13 which is the first switching element. The gate of the thyristor 20 which is the second switching element and the cathode of the thyristor 13 are connected with each other. The anode of the thyristor 13 is connected as illustrated to the anode of the diode 3.

The pulser coil 11 is connected at one end to the intermediate connecting point of the diodes 14 and 16 through the Zener diode 15 which is the third switching element and at the other end to the intermediate connecting point of the diodes 12 and 17.

Further, the intermediate connecting point of the diodes 14 and 17 is connected to the cathode of the thyristor 13 which is the first switching element and the agate of the thyristor 20 which is the second switching element. Further, the connecting intermediate point of the diodes 12 and 16 is connected to the gate of the thyristor 13 which is the first switching element.

Figure 2:
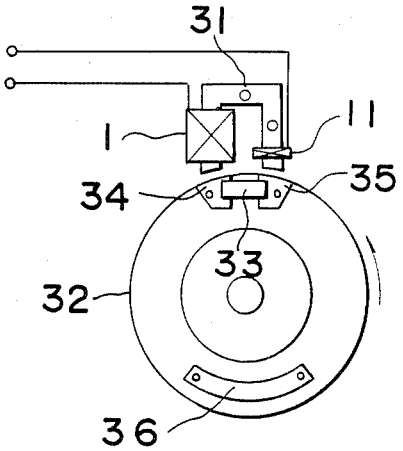
FIG. 2 is a schematic view of a magnet generator employed in the present invention.

In FIG. 2 a schematic formation of a magnet generator is shown having the above mentioned exciter coil 1 and pulser coil 11, the respective coils 1 and 11 are wound, divided into two magnetic poles, on an inverted U-shaped iron core 31 and are connected at the respective lead ends to the respective parts of the circuit in FIG. 1 which is the controlling circuit. A rotor 32 rotating in synchronization with the engine, has a magnet 33 embedded within it. Magnetic poles 34 and 35 are fitted to both ends of the magnet 33. A balance weight 36 is provided.

The operation of this contactless ignition device shall be described in the following.

The rotor 32, shown in FIG. 2, is normally adapted to rotate in the direction indicated by the arrow. When the engine is operated within the low speed rotation range, the voltage shown in FIGS. 3(*a*) and (*b*) are induced respectively in the exciter coil 1 and pulse coil 11. In the positive half period of the induced voltage of the exciter coil 11, the first condenser 4 will be charged with a positive voltage P. In the negative half period, the second condenser 8 will be charged with as negative voltage P′ to the trigger level of the Zener diode 10.

As the positive voltage Q of the pulser coil 11 has not reached the Zener voltage level of the Zener diode 15 which is the third switching element, the thyristor 13 of the first switching element will not conduct.

On the other hand, at the time $T_1$ of the negative voltage A′ of the half period of the pulser coil 11, the thyristor 13 which is the first switching element will be triggered to conduct through the course of the diode 12, gate and cathode of the thyristor 13 which is the first switching element, diode 14 and Zener diode 15 which is the third switching element in the order mentioned and the course of the diode 12, resistance 18, diode 14 and Zener diode 15 which is the third switching element in the order mentioned. At this time, the second condenser 8 which has been charged with the voltage P′ of the exciter coil 1 on the voltage level of the Zener diode 10 will be discharged through the course of the anode and cathode of the thyristor 13 which is in the first switching element and gate cathode of the thyristor 20 which is the second switching element in the order mentioned and the course of the anode and cathode of the thyristor 13 which is the first switching element and resistance 19 in the order mentioned to keep the thyristor in the conducting state. Thus, the first condenser 4 which has been charged with the positive voltage P of the exciter coil 1 will be discharged through the course of the anode and cathode of the thyristor 20 which is the second switching element, diode 9 and primary side of the ignition coil 5 in the order mentioned to generate a high voltage on the secondary side of the ignition coil 5 and generate a spark in the spark plug.

Figure 3:
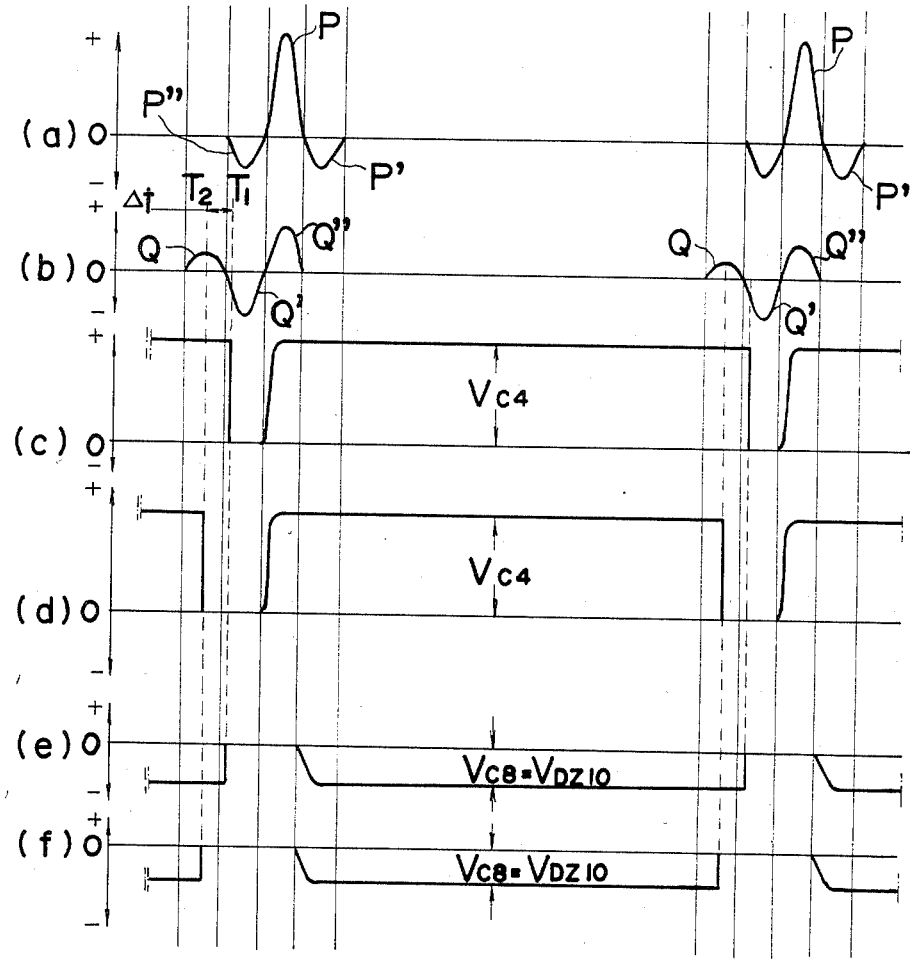
FIGS. 3(*a*), (*b*), (*c*), (*d*), (*e*), and (*f*) are time charts of signals of the respective parts of the above mentioned circuit diagram.

FIGS. 3(*c*) and (*e*) show respectively the characteristics of the voltage $V_{c4}$ of the condenser 4 and the characteristics of the voltage $V_{c8}$ of the condenser 8.

Figure 4:
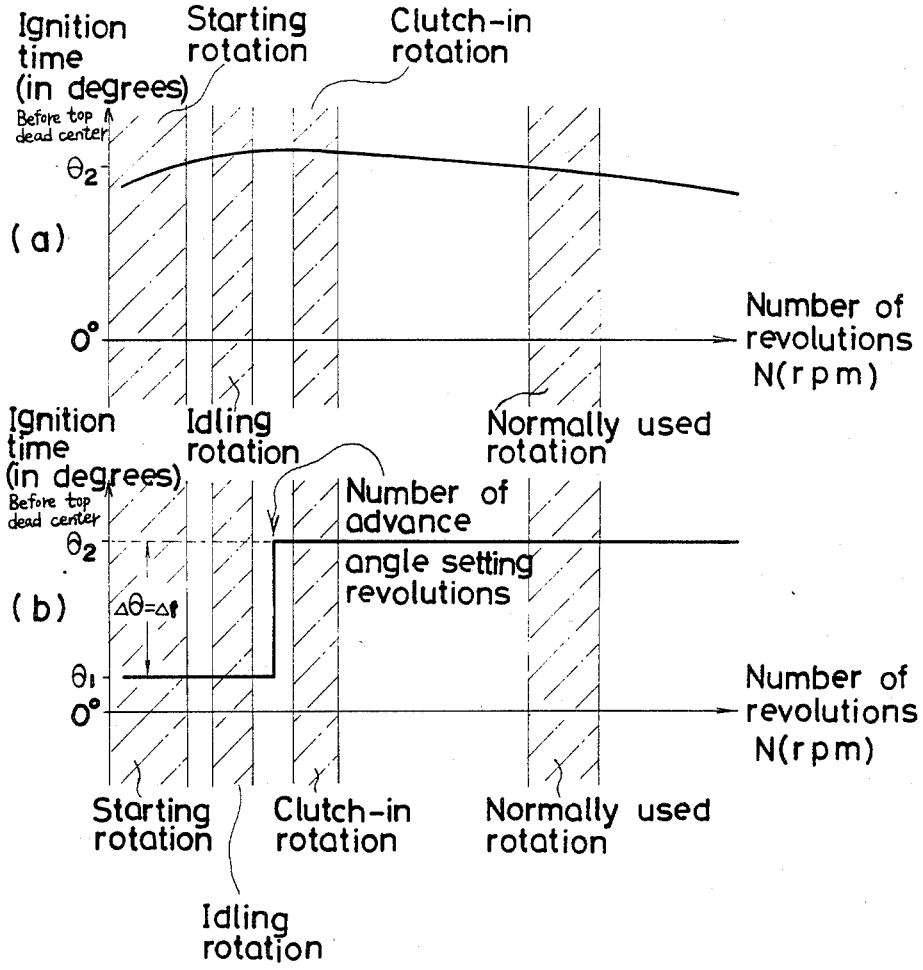
FIG. 4 shows the ignition time characteristic diagrams comparing a conventional condenser discharge type ignition device having no advance angle controlling circuit and that of the present invention.

When the igniting operation is so set as to be retarded to be near 10 degrees before the top dead center of the engine operation, the startability will be improved. FIG. 4(*a*) is a characteristic diagram of a conventional ignition timing having no such angle advance controlling circuit.

On the other hand, when the engine exceeds a predetermined number of revolutions, the induced voltage Q of the pulser coil 11 will rise to be above the Zener voltage of the Zener diode 15 which is the third switching element at the time $T_2$ point. Therefore, with the positive voltage Q of the pulser coil 11, the thyristor 13 which is the first switching element will be made to conduct through the course of the Zener diode 15 which is the third switching element, diode 16, gate and cathode of the thyristor 13 which is the first switching element and diode 17 in the order mentioned and the course of the Zener diode 15, diode 16, resistance 18 and diode 17 in the order mentioned. Thus, the second condenser 8 which had been charged with the negative voltage P′ of the exciter coil 1 on the voltage level of the Zener diode 10 will be discharged through the same course as at the time of starting ($T_1$ time). The thyristor 20 which is the second switching element will then be made to conduct, the positive voltage P of the exciter coil 1 will be discharged through the same course as at the time of starting ($T_1$ time) and a high voltage will be induced on the secondary side of the ignition coil 5.

Here, if the ignition timing advance time at the $T_1$ time is represented by $\Delta t$ and the ignition advance angle is represented by $\Delta\theta$, they will be as shown in the ignition timing characteristic diagram in FIG. 4(*b*).

By the way, as the thyristor 13 will be triggered to conduct with the negative voltage Q′ of the pulser coil 1 even at the time of starting and the constant number of advance angle setting revolutions, the second condenser 8 will not be charged with the negative voltage P″ of the exciter coil 1. Further, before reaching the number of advance angle setting revolutions, the positive voltage Q″ of the pulser coil 11 at the time of starting will reach the Zener voltage level of the Zener diode 15 which is the third switching element and will make the thyristor 13 which is the first switching element conduct but, as the charging voltage of the second condenser 8 is substantially zero, the thyristor 20 which is the second switching element will remain non-conductive. Even above the constant number of advance angle setting revolutions, the same operation will be made. Incidentally, the Zener diode 10 and second condenser 8 are connected in parallel with each other to protect the second condenser 8.

FIGS. 3(*d*) and (*f*) show respectively $V_{c4}$ characteristics of the first condenser 4 and $V_{c8}$ characteristics of the second condenser 8.

As a result, the discharge of the first condenser 4 will be advanced from the $T_1$ time to the $T_2$ time. That is to say, the trigger timing of the thyristor 20 which is the second switching element was at the $T_1$ time in the low speed rotation range but will be advanced to the $T_2$ time above the set rotation range to enable the ignition near 30 degrees before the top dead center of the engine. Consequently, high efficiency operation of the engine over the entire operation range is obtained.

As explained in detail above, the present invention comprises an exciter coil and pulser coil inducing voltages by the rotation of an internal combustion engine. A first condenser and second condenser are charged with the induced voltage of the exciter coil. Upon discharge of the first condenser an ignition coil receiving the discharged voltage feeds a high voltage to a spark plug. A first switching element conducting at the induced voltage of the pulser coil enables the discharge of the second condenser. A second switching element enables the discharge of the first condenser by rendering the conduction of the first switching element and the third switching element (Zener diode) conductive in the preset constant rotation range of the engine and drives the second switching element. Therefore, such advantages of improved startability and low speed stability of an internal combustion engine are obtained. The vibration and exhaust noise at the time of a low speed are reduced and, above the set constant rotation speed, the maximum output can be obtained with greatly improved fuel consumption efficiency.

What is claimed is:

1. A contactless ignition device for internal combustion engines comprising an exciter coil and pulser coil each inducing a voltage by rotation of an internal combustion engine, a first condenser charged with the positive induced voltage of said exciter coil, a second condenser charged with the negative induced voltage of said exciter coil, an ignition coil receiving the discharged voltage of said first condenser and feeding a higher voltage to a spark plug, an full wave rectifier having its input connected to said pulser coil through a Zener diode for determining the number of angle advancing revolutions of the engine, a first switching element made conductive by receiving the output voltage of said full wave rectifier and enabling the discharge of said second condenser and a second switching element made conductive by receiving the discharged voltage of said second condenser and enabling the discharge of said first condenser.

2. The ignition device for internal combustion engines according to claim 1 wherein said first switching element and second switching element are thyristors.

3. The ignition device according to claim 2 wherein said exciter coil and pulser coil are wound on a common iron core in opposition to a magnetic rotor rotating synchronously with the engine.

* * * * *